US007317422B2

(12) United States Patent
Yun et al.

(10) Patent No.: US 7,317,422 B2
(45) Date of Patent: Jan. 8, 2008

(54) BUILT-IN ANTENNA ASSEMBLY OF WIRELESS COMMUNICATION TERMINAL

(75) Inventors: Young Su Yun, Kyungki-do (KR); Wook Hee Lee, Kyungki-do (KR); Sun Kyu Han, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 11/534,901

(22) Filed: Sep. 25, 2006

(65) Prior Publication Data

US 2007/0126645 A1 Jun. 7, 2007

(30) Foreign Application Priority Data

Dec. 1, 2005 (KR) ..... 10-2005-0116293

(51) Int. Cl.
*H01Q 1/24* (2006.01)

(52) U.S. Cl. ..... 343/702

(58) Field of Classification Search ..... 343/702, 343/700 MS, 846

See application file for complete search history.

(56) References Cited

U.S. PATENT DOCUMENTS

| | | | | |
|---|---|---|---|---|
| 6,914,568 | B2 * | 7/2005 | Stoiljkovic et al. | 343/702 |
| 6,914,569 | B2 * | 7/2005 | Na | 343/702 |
| 2003/0179144 | A1 | 9/2003 | Takesako et al. | |

FOREIGN PATENT DOCUMENTS

| | | | |
|---|---|---|---|
| GB | 2 403 349 | A | 12/2004 |
| GB | 2 421 636 | A | 6/2006 |
| JP | 2001-156513 | A | 6/2001 |
| WO | 02/052678 | A1 | 7/2002 |
| WO | 03/012930 | A2 | 2/2003 |

OTHER PUBLICATIONS

UK Patent Office, Office Action mailed Jan. 11, 2007.

* cited by examiner

*Primary Examiner*—Hoang V. Nguyen
(74) *Attorney, Agent, or Firm*—Lowe Hauptman Ham & Berner

(57) ABSTRACT

A built-in antenna assembly of a wireless communication terminal is provided. A base is mounted on a substrate. A radiator is fixed onto an upper end of the base, and transmits/receives a signal. A terminal is extended along an outer surface of the base from the radiator to contact a contact pad protruded from the substrate. The terminal supplies a power to the radiator when in contact with the contact pad and is grounded. A terminal hooker is disposed on an underside surface of the base corresponding to a free end of the terminal so that the free end is fixed to the base. The invention allows easier and more flexible design for the terminal which is in electrical contact with the substrate of the built-in antenna. Moreover, the invention is universally applicable to various terminal models, and enhances productivity due to simpler configuration and easier assembling structure.

10 Claims, 8 Drawing Sheets

(a)

(b)

BUILT-IN ANTENNA ASSEMBLY OF WIRELESS COMMUNICATION TERMINAL

CLAIM OF PRIORITY

This application claims the benefit of Korean Patent Application No. 2005-116293 filed on Dec. 1, 2005 in the Korean Intellectual Property Office, the disclosure of which is incorporated herein by reference.

BACKGROUND OF THE INVENTION

1. Field of the Invention

The present invention relates to a built-in antenna assembly installed in a wireless telecommunication terminal, more particularly which more stably ensures electrical contact between the built-in antenna and a substrate, and enhances assembling capabilities due to simper configuration.

2. Description of the Related Art

In general, a wireless communication terminal refers to a portable communication device capable of transmitting/receiving voices, texts and image data through wireless communication. The examples include a personal communication service (PCS) terminal, a Personal Digital Assistant (PDA), a smart phone, a next-generation mobile communication (IMT-2000) terminal, a wireless LAN terminal and the like.

The wireless communication terminal adopts a helical antenna or a dipole antenna to enhance its transmission and reception sensitivity. These are external antennas, which thus are extended out of the wireless terminal.

The external antennas are advantageously characterized by non-directional radiation. At the same time, they are disadvantageously prone to damage by external force, hardly portable and designed with poor aesthetic appearance.

To overcome such a problem, plate-shaped built-in antennas such as a micro-strip patch antenna or inverted F-type antenna have been recently adopted in the wireless communication terminal since they can be installed in the terminal without being extended outward.

FIG. 1 is a perspective view illustrating a conventional built-in antenna assembly. The built-in antenna assembly 10 includes abase 11, a radiator 12 and a terminal 13 and is mounted on a substrate (not illustrated).

The base 11 is a structure fixed onto the substrate 11. The radiator 12 is made of dielectrics and disposed on an upper surface of the base 11, constituting a transmitter/receiver of the antenna. The terminal 13 is made of the same dielectrics as the radiator. The terminal 13 includes a feeding pin 13*a* and a ground pin 13*b* grounded to a feeding part formed on the substrate.

FIGS. 2(*a*) and (*b*) and FIGS. 3(*a*) and (*b*) illustrate various terminal supporting structures 20 and 30. The terminal supporting structures 20 and 30, when mounted on the substrate, prevent defective electrical contact between the terminal 13 and the substrate, ensuring stable contact therebetween.

The conventional terminal supporting structure 20 shown in FIGS. 2(*a*) and (*b*) is a forward terminal supporting structure. That is, a guider 21 has a guide hole 21*a* so that the terminal bent inwardly (rightward in FIG. 2) in a longitudinal middle part is inserted in the guide hole 21*a*. Also, a rubber member 23 is disposed underneath the base 11 corresponding to an upwardly bent bending part 14 which is formed on a lower end of the terminal 13. Here, the terminal 13 inserted into the guider 21 formed on a leading end of the base 11 is positioned in an inward direction of the base.

In this case, when the base 11 of the built-in antenna 10 and the substrate P are assembled together, the terminal 13 supported by the terminal supporting structure 20 is inclined downward at a predetermined angle 01 from a horizontal line when the bending part 14 is in contact with a contact pad 25 disposed on the substrate P. Here, the terminal 13 is elastically deformed to absorb pressure from A direction and elastically spring back.

In addition, the conventional terminal supporting structure 30 of FIGS. 3(*a*) and (*b*) is an inverse terminal supporting structure. That is, a guider 31 has a guide hole 31*a* so that a terminal 13 bent outward (leftward in FIG.3) in a longitudinal middle part is inserted into the guide hole 31*a*. A rubber member 33 is disposed underneath the guider 31 corresponding to a bending part 14 which is bent upward on a lower end of the terminal 13. The terminal 13 inserted into the guider 31 formed on a leading end of the base 11 is positioned in an outward direction from the base 11.

In this case, when the base 11 of the built-in antenna 10 and the substrate P are assembled together, the terminal 13 is inclined downward at a predetermined angle θ2 from a horizontal line when the bending part 14 is in contact with a contact pad 35 formed on the substrate P. Here, the terminal 13 is elastically deformed to absorb pressure from A direction and elastically spring back.

However, in the built-in antenna 10 employing this conventional terminal support structure 20 and 30, the terminal 13 should be bent in an adequate extent to be electrically connected to the contact pad 25 and 35 when the built-in antenna 10 and the substrate P are assembled together. That is, a working distance between the bending part 14 of the bent terminal 13 and the contact pad 25 and 35 and weight gathered on the terminal 13 should be taken into account. But it is time-consuming to design the terminal in this fashion, and any errors in design may cause defective contact between the bending part 14 and the contact pad 25 and 35, failing to produce a circuit.

Also, in assembling the built-in antenna 10, it is an intricate job to manually draw downward the terminal 13 extended from the radiator 12 through the guide hole 21*a* and 31*a* of the guider 21 and 31. Thus this undermines work productivity.

Moreover, the terminal set providers do not have any design standard for the terminal which universally covers various terminal types. Therefore it is difficult to perform RF matching and form the terminal 13 or the contact pad 25 and 35 uniformly in a desired position of the antenna. On the contrary, the terminal 13 needs to be individually tailor-designed for respective various terminal models.

SUMMARY OF THE INVENTION

The present invention has been made to solve the foregoing problems of the prior art and therefore an object according to certain embodiments of the present invention is to provide a built-in antenna assembly of a wireless telecommunication terminal which ensures simpler and more flexible design for a terminal which is in electrical contact with a substrate of the built-in antenna, and allows stable contact of the terminal, thereby universally applicable to various terminal models.

Another object according to certain embodiments of the invention is to provide a built-in antenna assembly of a wireless telecommunication terminal which ensures a simpler overall configuration and an easier assembly structure, thereby enhancing work productivity.

According to an aspect of the invention for realizing the object, there is provided a built-in antenna assembly of a wireless communication terminal including a base mounted on a substrate; a radiator for transmitting and receiving a signal, the radiator fixed onto an upper surface of the base; a terminal extended along an outer surface of the base from the radiator to contact a contact pad protruded from the substrate, the terminal supplying a power to the radiator when in contact with the contact pad and being grounded; and a terminal hooker disposed on an underside surface of the base corresponding to a free end of the terminal so that the free end is fixed to the base.

Preferably, the terminal includes an extension part extended from the radiator onto the underside surface of the base and a tension part extended to a predetermined length from a lower end of the extension part and having a free end bent toward the substrate.

Preferably, the base comprises at least one fixed pillar formed thereon, the fixed pillar inserted into a fixing hole perforated through the radiator or the terminal.

More preferably, the fixed pillar comprises a fusion pillar which is thermally fused to fix the radiator.

Preferably, the base has at least one elastomer disposed on the underside surface thereof, the elastomer corresponding to an upper surface of the terminal.

Preferably, the contact pad includes a fixed end fixed to the substrate and an elastic free end bent from the fixed end to be disposed in parallel with the fixed end.

More preferably, the elastic free end includes an embossing portion bent to partially contact an underside surface of the terminal.

Preferably, the terminal hooker includes a hook step onto which a free end of the tension part is elastically hooked and a hook rib extended downward perpendicularly from the underside surface of the base so that the hook step is disposed on a lower end of the base.

Preferably, the free end of the terminal has a bending part therein to be resiliently hooked onto the terminal hooker.

Preferably, the base comprises upper and lower bases assembled together to form an inner space of a predetermined size.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Preferred embodiments of the present invention will now be described in detail with reference to the accompanying drawings.

Figure 1:
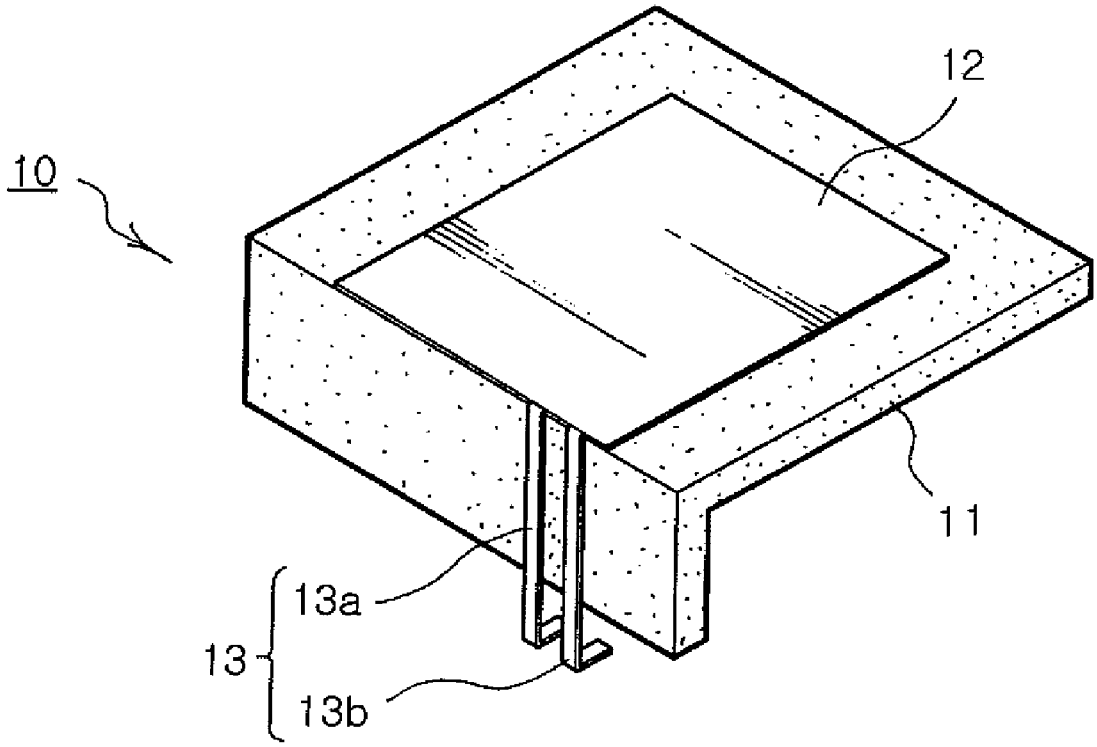
PRIOR ART FIG. 1
FIG. 1 is a perspective view illustrating a conventional built-in antenna assembly.
Figure 2:
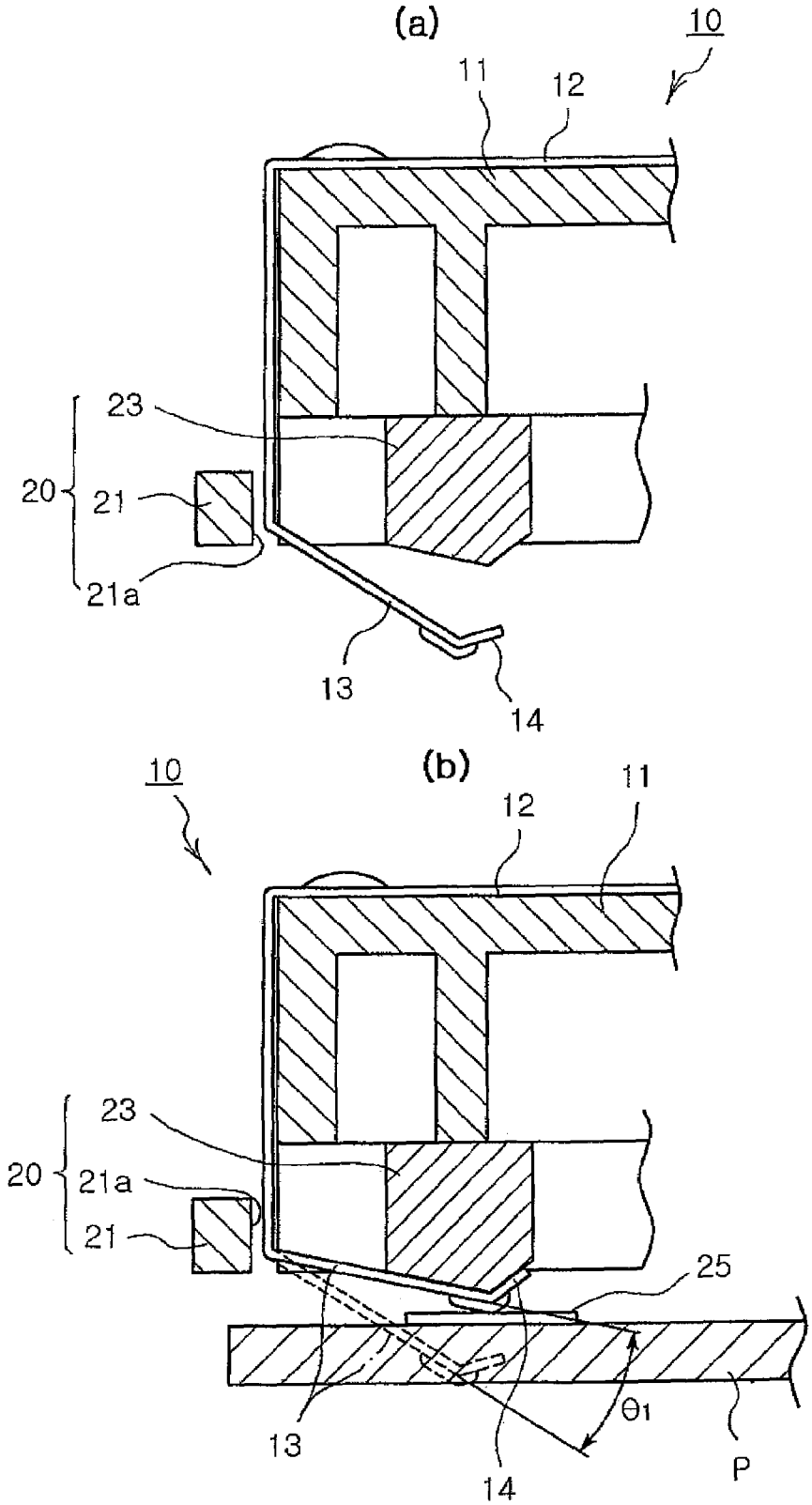
PRIOR ART FIG. 2
FIGS. 2(*a*) and (*b*) are cross-sectional views illustrating a forward terminal support structure applied to the conventional built-in antenna assembly.
Figure 3:
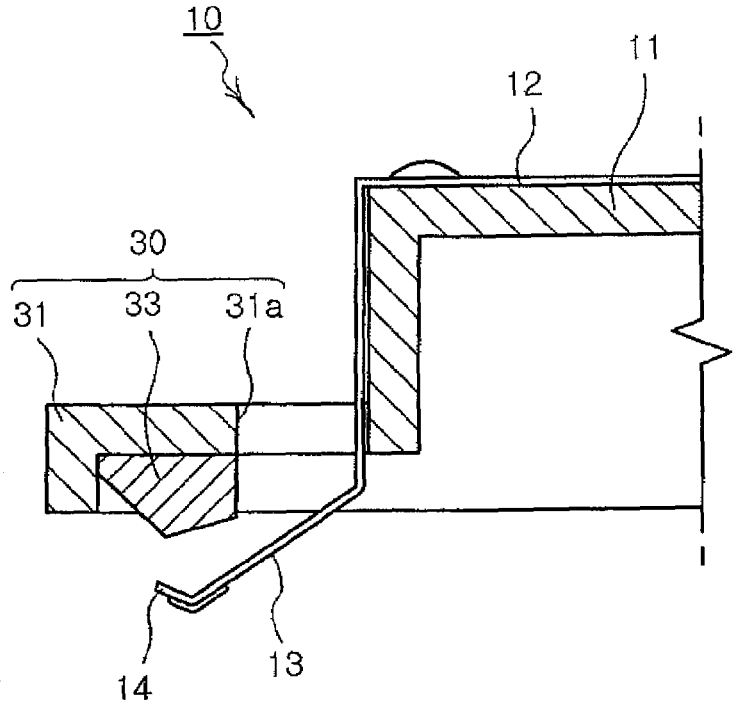
PRIOR ART FIG. 3
FIGS. 3(*a*) and (*b*) are cross-sectional views illustrating an inverse terminal support structure applied to the conventional built-in antenna assembly.
Figure 3:
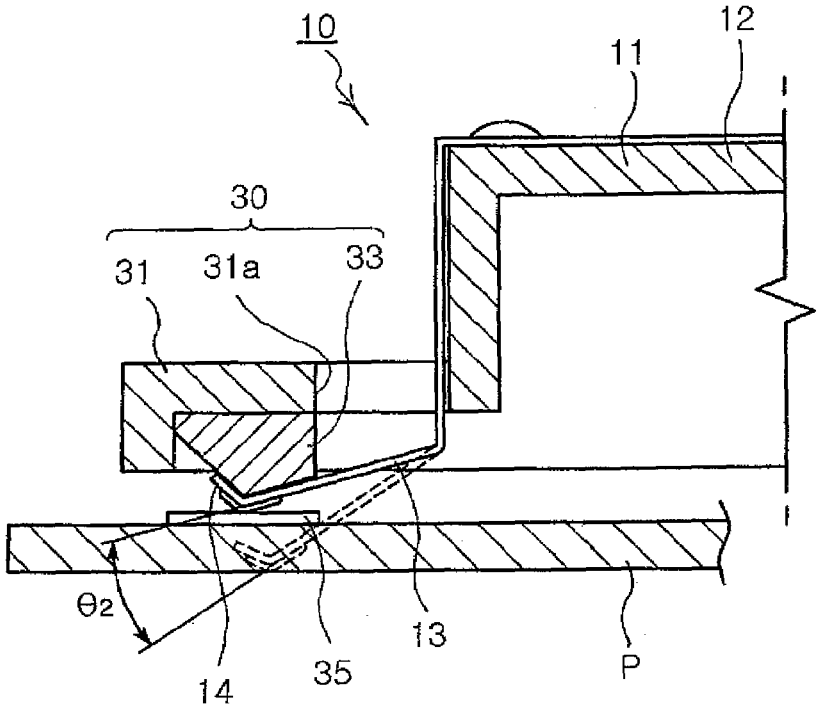
PRIOR ART FIG. 3
Figure 4:
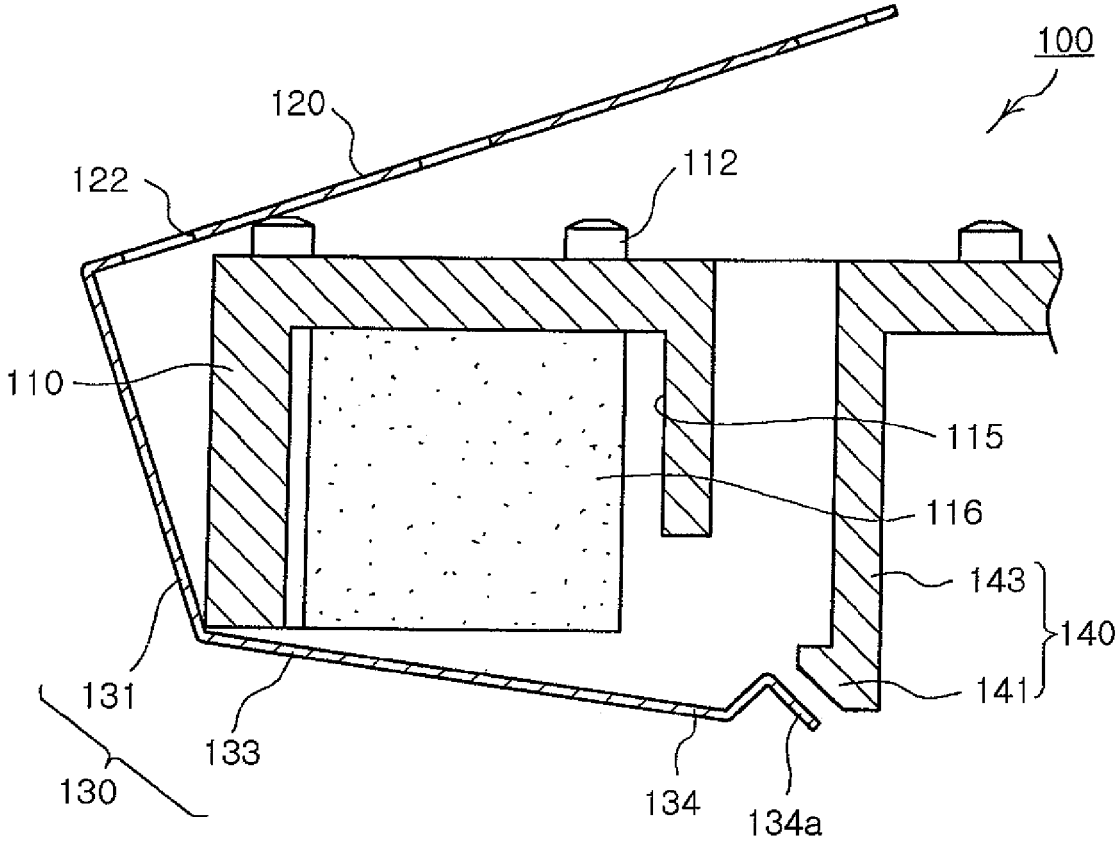
FIG. 4 is a cross-sectional view of a built-in antenna assembly of a wireless telecommunication terminal according to the invention, in which a radiator is being assembled into a base of the built-in antenna assembly.
Figure 5:
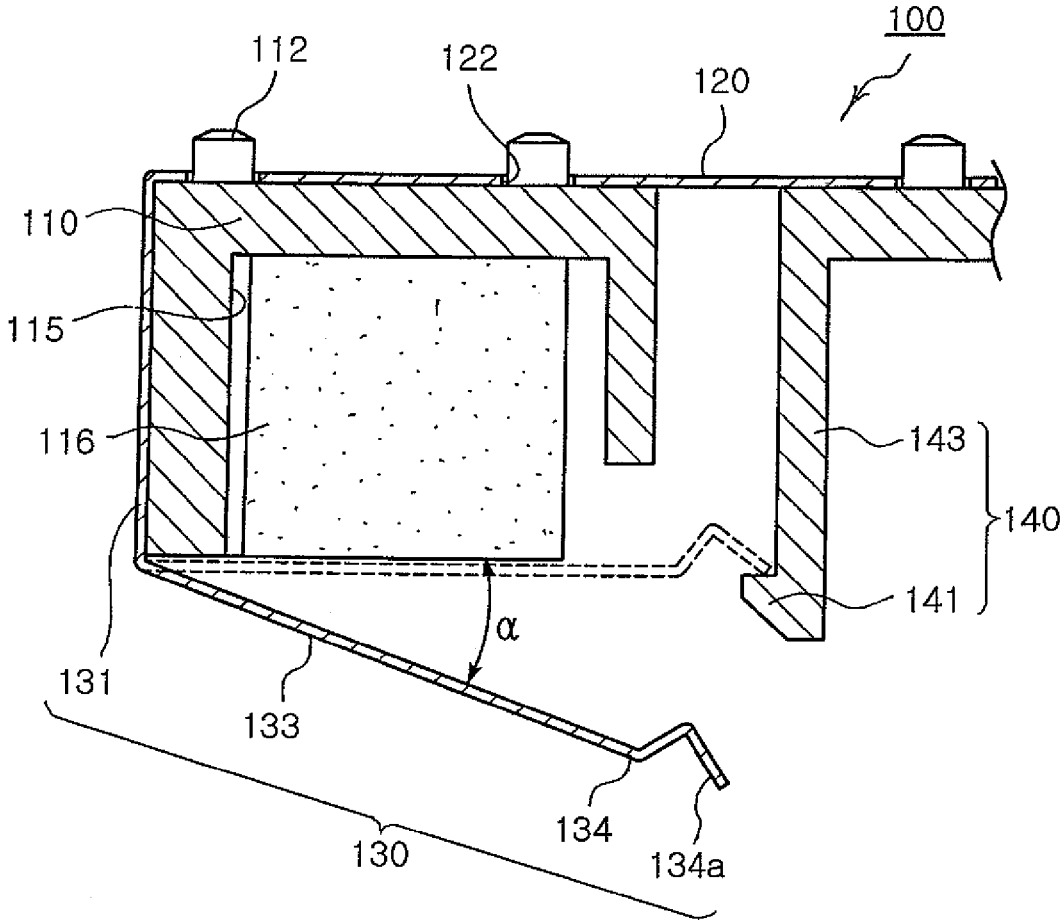
FIG. 5 is a cross-sectional view of a built-in antenna assembly of a wireless telecommunication terminal according to the invention, in which a terminal is being fixed to a base of the built-in antenna assembly.
Figure 6:
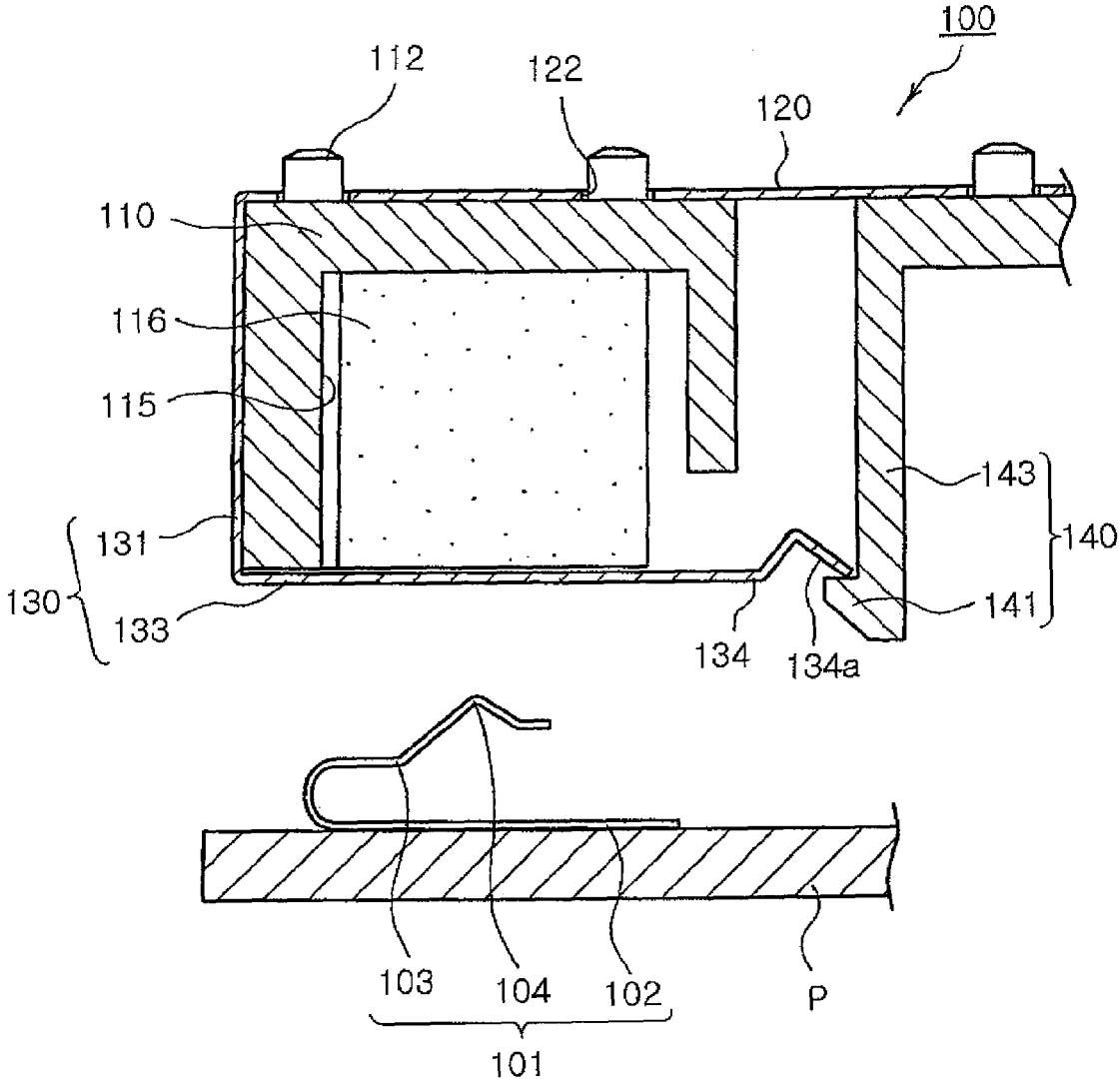
FIG. 6 is a cross-sectional view of a built-in antenna assembly of a wireless telecommunication terminal according to the invention, in which the built-in antenna assembly is being assembled into a substrate.
Figure 7:
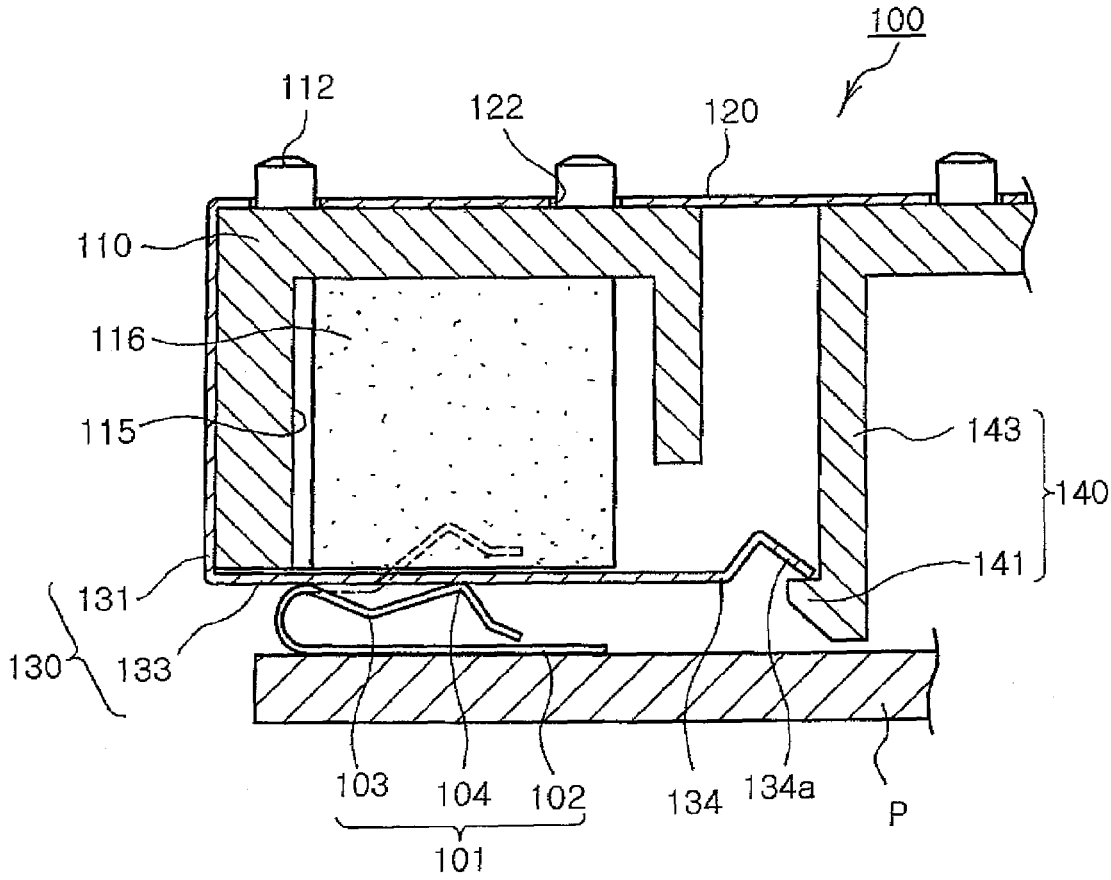
FIG. 7 is a cross-sectional view illustrating a built-in antenna assembly of a wireless telecommunication terminal according to the invention.

FIG. 4 is a cross-sectional view in which a radiator is assembled in a base of a built-in antenna assembly of a wireless telecommunication terminal according to FIG. 4. FIG. 5 is a cross-sectional view in which a terminal is fixed to a base of a built-in antenna assembly of a wireless telecommunication terminal. FIG. 6 is a cross-sectional view in which a built-in antenna assembly is assembled in a substrate according to the invention. FIG. 7 is a cross-sectional view illustrating a built-in antenna assembly of a wireless telecommunication terminal according to the invention.

As shown in FIGS. 4 to 7, the built-in antenna assembly 100 includes a base 110, a radiator 120, a terminal 130 and a terminal hooker 140. This allows the built-in antenna assembly 100 to be in more stable electrical contact with the substrate and to be designed more flexibly.

The base 10 is a fixed structure mounted on the substrate P and molded of an insulating material.

Preferably the base 110 includes upper and lower base parts, which are assembled together to constitute the base 110 and configured to form an internal space so that an actuator for generating vibration or sound singly or simultaneously can be embedded therein.

The radiator 120 receives an electrical signal from the substrate and converts it into a radio wave to transmit to the outside, and receives a radio wave of a specific frequency wave from the outside. The radiator 120 is made of dielectrics.

Preferably, the radiator 120 is sized substantially equal to an upper surface of the base 110 to maximize transmission and reception capabilities of the antenna.

Here, at least one fixed pillar 112 is protruded to a uniform height from an upper end of the base 110 corresponding to the radiator 120. The fixed pillar 112 is inserted into a fixing hole 122 perforated through the radiator 120.

The fixing hole 122 may be perforated through the terminal 130 corresponding to the upper surface of the base 110.

Preferably, the fixed pillar 112 is structured as a fusion pillar. Thus, the fixed pillar 112 is fused by external heat after assembling of the radiator 120 and the base 120 and then integrated with the radiator, thereby fixing the radiator 120 solidly.

Further, the terminal 130 supplies a power to the radiator 120 when in contact with the substrate P, and is grounded. The terminal 130 includes an extension part 131 and a tension part 133. The extension part 131 is extended at a predetermined length from a side of the radiator 120 along an outer surface of the base 110 to a lower end of the base 110. The terminal 130 is made of dielectrics.

The tension part 133 has a free end 134 extended to a predetermined length at a predetermined angle a from a lower end of the extension part 131. Also, the free end 134 of the tension part 133 is bent toward the substrate P. Accordingly, the tension part 133 is in resilient contact with a contact pad 101 protruded from the substrate P.

The tension part 133 is inclined downward at a predetermined angle α with respect to a lower surface of the base 110. Thus, the tension part 133 has the free end 134 hanging downward.

The contact pad 101 is in contact with an underside surface of the tension part 133 when the substrate P and the base 110 are assembled together. The contact pad 101 includes a fixed end 102 soldered onto the substrate P to be electrically connected to a pattern circuit formed on the substrate P and an elastic free end 103 disposed in parallel with the fixed end 102 and primarily bent to have elasticity.

Here, preferably the elastic free end 103 formed on the contact pad 101 has an embossing portion 104 secondarily bent to partially contact the underside surface of the tension part 133.

Preferably, a maximum distance L2 between the fixed end 10 and the elastic free end 103 is greater than a distance between the base 110 and the substrate P assembled. Here, the base 110 and the substrate P, when assembled together, are spaced from each other to impart sufficient elasticity so that the tension part 133 and contact pad 101 are in stable contact with each other.

Meanwhile, the terminal 130 is divided into a feeding pin for forming a feeding line from which an external power is supplied and a ground pin for forming a ground line. Here, the feeding pin contacts the feeding contact pad and the ground pin contact the ground contact pad.

Also, the base 10 has an elastic casing 115 in a lower part thereof. The elastic casting 115 houses at least one elastomer 16 therein and has an underside surface contacting an upper surface of the tension part 133.

Preferably the elastomer 116 has an underside surface substantially coplanar with the lower end of the base 116 or protruded downward.

The terminal hooker 140 is disposed underneath the base 110 corresponding to the free end 134. Thus with the free end 134 of the terminal 130 fixed to the base 110, the tension part 133 is maintained horizontally even.

The terminal hooker 140 includes a hook step 141 and a hook rib 143. The hook step 141 is elastically hooked to the free end 134 of the tension part 133. The hook rib 143 is extended downward perpendicularly from the underside surface of the base 110 so that the hook step 141 is disposed on a lower end of the base 110.

Here, preferably the free end 134 is hooked onto the hook step 141 such that the tension part 133 has an upper surface in contact with and coplanar with an underside surface of the elastomer 116.

Also, preferably the free end 134 of the tension part 133 has a bending part 134*a* bent so as to be resiliently hooked onto the hook step 143 of the hook rib 143.

To assemble the built-in antenna assembly 100 structured as above, the radiator 120 is disposed on the upper surface of the base 110 and a fixed pillar 112 of the base 110 is inserted into a fixing hole 120 to be primarily fixed thereto. Then, the fixed pillar 112 is thermally fused to securely fix the radiator 120 onto the base 110.

Here, as shown in FIG. 4, the terminal 130 extended from the radiator 120 has the tension part 133 extended downward at a predetermined angel α so that a distance between the radiator 120 and the tension part 133 is sufficiently larger than a height of the base 110. Accordingly, the radiator 120 is pulled downward from the upper surface of the base 110 to insert the fixed pillar 112 into the fixing hole 122. This allows the terminal 130 to be more easily assembled to be disposed on an outer periphery of and on the lower end of the base 110.

Figure 8:
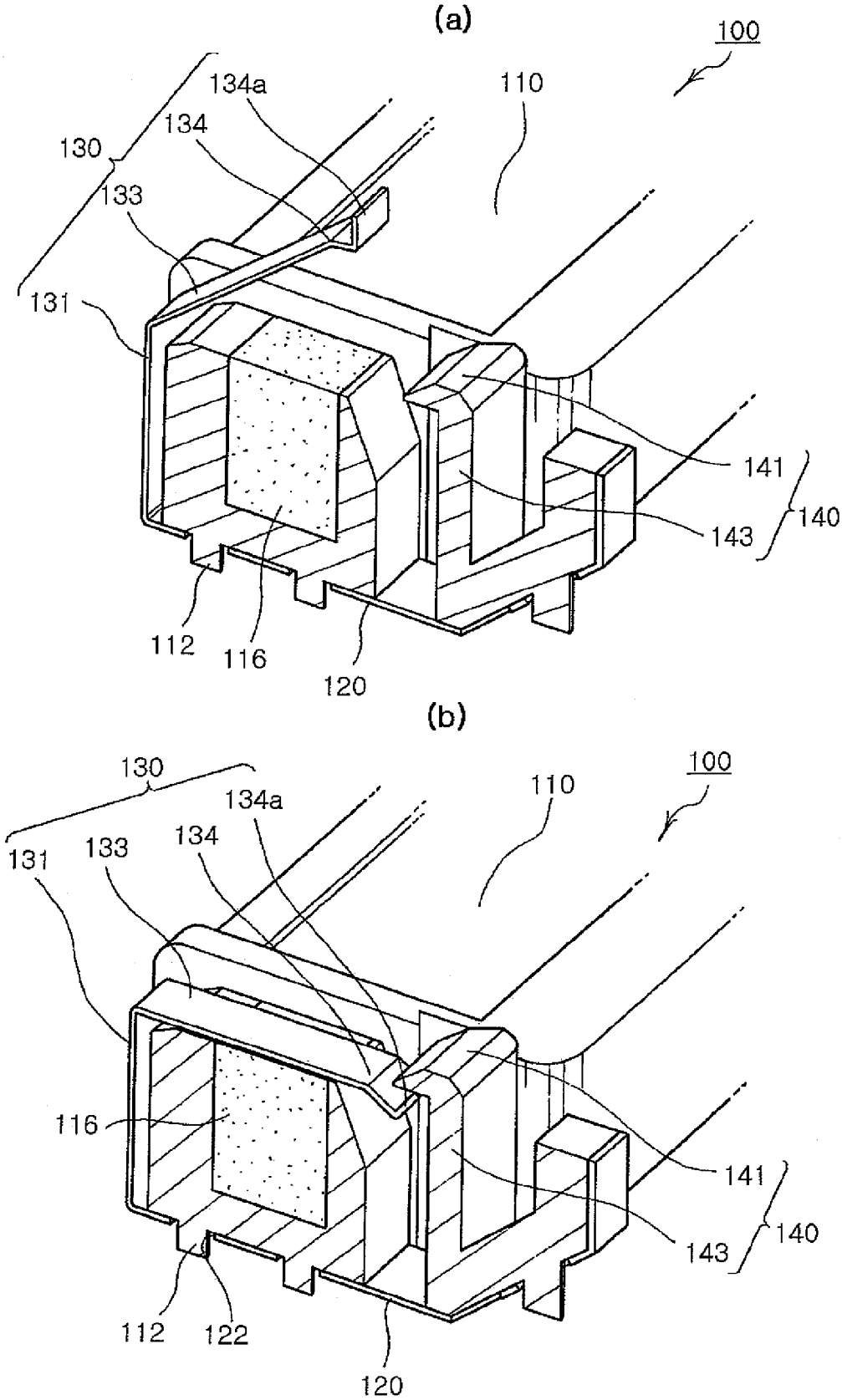
FIGS. 8(*a*) and (*b*) are cross-sectional views of a built-in antenna assembly of a wireless telecommunication terminal according to the invention, in which a terminal hooker is assembled into a terminal of the built-in antenna assembly.

Subsequently, with the radiator 120 assembled in the base, as shown in FIG. 8(*a*), when the free end 134 of the tension part 133 is manually pressurized toward the terminal hooker 140 formed underneath the base 110 via tweezers or a jig, the tension part 133 is elastically deformed toward the base 110 to apply downward elastic force thereto.

As shown in FIG. 8(*b*), with pressure applied toward the base 110, the free end 134 of the tension part 133 pushes the hook step 141 of the terminal hooker 140 contacting the free end 134 in an outward direction, while sliding past the hook step 141. Then, the free end 134 is securely hooked onto the hook step 141 of the hook rib 143 which is elastically recovered.

Here, the free end 134 of the tension part 133 has a bending part 134*a* therein, thereby ensuring the free end 134 to be pressurized upward and more smoothly hooked onto the hook step 141.

Accordingly, the tension part 133 of the terminal 130 is maintained horizontally even with the substrate P on the underside surface of the base 110.

Next, an assembly step (not illustrated) formed on the base 110 is assembled into an assembly hole (not illustrated). Therefore, with the base 110 mounted on the substrate P, the tension part 133 at an underside surface contacts the contact pad 101. Then the elastic free end 103 of the contact pad is elastically deformed, applying upward elastic force to the tension part 133. Then, the tension part 133 and the contact pad 101, in contact with each other, generate a contact pressure.

In this case, the radiator 120 is stably configured with a power supply line for supplying an external power through a terminal 130 contacting the contact pad 101 of the substrate P and a ground line. This allows the radiator 120 to serve as an antenna for transmitting and receiving a signal to/from the inside and outside.

As set forth above, according to preferred embodiments of the invention, a terminal has an extension part extended along an outer surface of a base from a radiator fixed onto the base, and a tension part bent toward the substrate from a lower end of the base corresponding to a contact pad formed on the substrate. Also, a terminal hook is formed to hook the terminal onto the base. Therefore, the tension part is in contact with the contact pad when the substrate and the base are assembled together, thereby achieving a series of circuits for supplying a power to the radiator and being grounded. This ensures easier and more flexible design for the terminal, and stable and reliable contact of the terminal.

Moreover, the invention is universally applicable to various terminal models, enabling the terminal to be standardized in design and thus mass-produced.

In addition, the invention simplifies configuration of a base where the radiator is assembled and an assembly structure over the prior art, thereby enhancing work productivity.

While the present invention has been shown and described in connection with the preferred embodiments, it will be apparent to those skilled in the art that modifications and variations can be made without departing from the spirit and scope of the invention as defined by the appended claims.

What is claimed is:

1. A built-in antenna assembly of a wireless communication terminal comprising:

a base mounted on a substrate;

a radiator for transmitting and receiving a signal, the radiator fixed onto an upper surface of the base;

a terminal extended along an outer surface of the base from the radiator to contact a contact pad protruded from the substrate, the terminal supplying a power to the radiator when in contact with the contact pad and being grounded; and a terminal hooker disposed on an underside surface of the base corresponding to a free end of the terminal so that the free end is fixed to the base.

2. The built-in antenna assembly according to claim 1, wherein the terminal includes an extension part extended from the radiator onto the underside surface of the base and a tension part extended to a predetermined length from a lower end of the extension part and having a free end bent toward the substrate.

3. The built-in antenna assembly according to claim 1, wherein the base comprises at least one fixed pillar formed thereon, the fixed pillar inserted into a fixing hole perforated through the radiator or the terminal.

4. The built-in antenna assembly according to claim 3, wherein the fixed pillar comprises a fusion pillar which is thermally fused to fix the radiator.

5. The built-in antenna assembly according to claim 1, wherein the base has at least one elastomer disposed on the underside surface thereof, the elastomer corresponding to an upper surface of the terminal.

6. The built-in antenna assembly according to claim 1, wherein the contact pad includes a fixed end fixed to the substrate and an elastic free end bent from the fixed end to be disposed in parallel with the fixed end.

7. The built-in antenna assembly according to claim 6, wherein the elastic free end includes an embossing portion bent to partially contact an underside surface of the terminal.

8. The built-in antenna assembly according to claim 1, wherein the terminal hooker includes a hook step onto which a free end of the tension part is elastically hooked and a hook rib extended downward perpendicularly from the underside surface of the base so that the hook step is disposed on a lower end of the base.

9. The built-in antenna assembly according to claim 1, wherein the free end of the terminal has a bending part therein to be resiliently hooked onto the terminal hooker.

10. The built-in antenna assembly according to claim 1, wherein the base comprises upper and lower bases assembled together to form an inner space of a predetermined size.

* * * * *